US009885177B2

(12) United States Patent
Gomes et al.

(10) Patent No.: US 9,885,177 B2
(45) Date of Patent: Feb. 6, 2018

(54) MASONRY WALL ASSEMBLY

(71) Applicants: Board of Regents, The University of Texas System, Austin, TX (US); Dabney Staub Gomes, Austin, TX (US)

(72) Inventors: Francisco Henning Gomes, Austin, TX (US); Dabney Staub Gomes, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 15/272,600

(22) Filed: Sep. 22, 2016

(65) Prior Publication Data

US 2017/0009448 A1 Jan. 12, 2017

Related U.S. Application Data

(62) Division of application No. 14/465,421, filed on Aug. 21, 2014, now Pat. No. 9,476,200.

(Continued)

(51) Int. Cl.
*E04C 3/30* (2006.01)
*E04B 2/24* (2006.01)

(Continued)

(52) U.S. Cl.
CPC ..... *E04B 2/24* (2013.01); *E04B 2/22* (2013.01); *E04C 1/39* (2013.01); *E04C 1/397* (2013.01); *E04B 2002/0247* (2013.01)

(58) Field of Classification Search
CPC ..... E04B 2/06; E04B 2/10; E04B 2/16; E04B 2/26; E04B 2/46; E04B 2/22; E04B 2/12
See application file for complete search history.

(56) References Cited

U.S. PATENT DOCUMENTS 1,064,498 A 6/1913 Landis et al.
1,485,007 A 2/1924 Zahn et al.

(Continued)

FOREIGN PATENT DOCUMENTS

GB 882577 A 11/1961

OTHER PUBLICATIONS

National Concrete Masonry Association "NCMA TEK 14-20A" ,Structural (2002).

(Continued)

*Primary Examiner* — Gisele Ford

(74) *Attorney, Agent, or Firm* — Meunier Carlin & Curfman LLC

(57) ABSTRACT

The present invention includes a method and a unit for a masonry wall system, each unit comprising a face shell wherein the interior surface has a transverse axis running from the top surface to the bottom surface of the face shell, and one or more webs having a front end and a rear end, wherein the rear end of each web is integral with or attached to the interior surface of the face shell along the transverse axis. The method for wall construction further comprising positioning one or more vertical reinforcement rods or tendons with one end embedded in a wall-foundation and laying a layer wall units on the wall-foundation such that the one or more webs of the layers of wall units are aligned, and the vertical reinforcement rods or tendons run through or are adjacent to the webs of the wall units.

21 Claims, 15 Drawing Sheets

Related U.S. Application Data

(60) Provisional application No. 61/869,311, filed on Aug. 23, 2013.

(51) Int. Cl.

| | |
|---|---|
| ***E04B 2/22*** | (2006.01) |
| ***E04C 1/39*** | (2006.01) |
| *E04B 2/02* | (2006.01) |

(56) References Cited

U.S. PATENT DOCUMENTS

| | | | |
|---|---|---|---|
| 1,675,093 | A | 6/1928 | Conley et al. |
| 2,008,775 | A | 7/1935 | Staman et al. |
| 2,684,589 | A | 7/1954 | Perreton |
| 2,881,613 | A | 4/1959 | Johnson et al. |
| 2,929,236 | A | 3/1960 | Steward et al. |
| 3,222,830 | A | 12/1965 | Ivany et al. |
| 3,233,380 | A | 2/1966 | Rosenfeld et al. |
| 3,562,988 | A | 2/1971 | Gregoire |
| 3,968,615 | A | 7/1976 | Ivany et al. |
| 4,123,881 | A | 11/1978 | Muse |
| 4,167,840 | A | 9/1979 | Ivany et al. |
| 4,640,071 | A | 2/1987 | Haener et al. |
| 4,655,018 | A | 4/1987 | Pardo et al. |
| 4,704,832 | A | 11/1987 | Vassiliadis et al. |
| 4,986,049 | A | 1/1991 | Kennedy et al. |
| 5,007,218 | A | 4/1991 | Bengtson et al. |
| 5,066,440 | A | 11/1991 | Kennedy et al. |
| 5,138,808 | A | 8/1992 | Bengtson et al. |
| 5,163,261 | A | 11/1992 | O'Neill et al. |
| 5,209,037 | A | 5/1993 | Kennedy et al. |
| 5,321,926 | A | 6/1994 | Kennedy et al. |
| 5,528,874 | A | 6/1996 | Schmid et al. |
| 5,901,520 | A | 5/1999 | Abdul-Baki et al. |
| 6,065,265 | A | 5/2000 | Stenekes |
| 6,082,067 | A | 7/2000 | Bott |
| 6,223,493 | B1 | 5/2001 | Ruggeri et al. |
| 6,250,038 | B1 | 6/2001 | Akamine et al. |
| 6,513,293 | B2 | 2/2003 | Miller et al. |
| 6,735,915 | B1 | 5/2004 | Johnson et al. |
| 6,978,581 | B1 | 12/2005 | Spakousky et al. |
| 7,086,811 | B2 | 8/2006 | Lewis et al. |
| 7,096,636 | B1 | 8/2006 | Neill et al. |
| D530,832 | S | 10/2006 | Rainey et al. |
| D574,517 | S | 8/2008 | Foster et al. |
| 7,497,646 | B2 | 3/2009 | Price et al. |
| 7,739,841 | B1 | 6/2010 | Puckett et al. |
| 7,739,845 | B2 | 6/2010 | Kennedy et al. |
| D626,662 | S | 11/2010 | Bott et al. |
| 7,823,360 | B1 | 11/2010 | Cottle et al. |
| D632,805 | S | 2/2011 | Bott et al. |
| D636,897 | S | 4/2011 | Bott et al. |
| 8,266,855 | B1 | 9/2012 | Altararwah |
| 8,800,235 | B2 | 10/2014 | Lacroix et al. |
| 2006/0059839 | A1 | 3/2006 | Azar et al. |
| 2006/0150559 | A1 | 7/2006 | Haener et al. |
| 2010/0018150 | A1 | 1/2010 | Azar et al. |
| 2010/0043335 | A1 | 2/2010 | O'Connor et al. |
| 2012/0167516 | A1 | 7/2012 | Dyson et al. |
| 2014/0174013 | A1* | 6/2014 | Hohmann, Jr. ..... E04B 1/4185 52/565 |
| 2015/0052837 | A1 | 2/2015 | Gomes |

OTHER PUBLICATIONS

National Concrete Masonry Association "NCMA TEK 3-14", Construction (2002).

Inglesby, et al., "Pass the Post, Please", Mason Contractors Association of America, Sep. 16, 2002; 4 pp.

Olstag, William Peter "Post-Tensioned Single Wythe Concrete Masonry Walls" May 1986, A Thesis in Architectural Engineering, The Pennsylvania.State University, The Graduate School, Department of Architectural Engineering.

Office Action issued in U.S. Appl. No. 29/556,139, dated Nov. 25, 2016.

* cited by examiner

MASONRY WALL ASSEMBLY

CROSS-REFERENCE TO RELATED APPLICATIONS

This application is a divisional patent application of U.S. application Ser. No. 14/465,421, entitled "Masonry Wall Assembly," filed Aug. 21, 2014, which claims priority to U.S. Provisional Application Ser. No. 61/869,311, filed Aug. 23, 2013, the entire contents of which are incorporated herein by reference.

STATEMENT OF FEDERALLY FUNDED RESEARCH

Not Applicable.

NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

TECHNICAL FIELD OF THE INVENTION

The present invention relates in general to the field of masonry structures and methods of installing the same, and more particularly, to a single face shell masonry wall assembly.

BACKGROUND OF THE INVENTION

Without limiting the scope of the invention, its background is described in connection with masonry wall construction and reinforcement systems.

U.S. Pat. No. 5,138,808, issued to Bengtson, et al., teaches a masonry block system that uses blocks formed with minimum webbing to minimize heat flow. Briefly, the patent teaches a wall system that is formed into a unitary structure using blocks. The wall also uses threaded post-tensioning rods tied to reinforcement rods in the wall footer and extending through the voids that contain polyurethane foam in the respective blocks to a top plate positioned on top of the wall.

U.S. Pat. No. 7,033,116, issued to Ward, et al., teaches a method of rammed-earth building construction wherein post-tensioning rods are anchored to a concrete footing so that the wall is post-tensioned to enhance the ability of the wall to receive lateral loading without failing in tension. The wall is then topped with a concrete bond beam and a retaining plate.

U.S. Pat. No. 6,195,955, issued to Kostopoulos, et al., teaches a method and apparatus for constructing a concrete block wall. Briefly, the patent teaches a concrete block wall constructed of concrete blocks each having one or more vertical openings. The patent includes the steps of the layering the blocks to generally align the vertical openings to initiate formation of the wall and placing reinforcement bars through the aligned openings. The wall also utilizes a connector that tightly grips each respective bar to form a frictional engagement of the connector and the bars.

U.S. Pat. No. 6,505,450 issued to Locke, et al., teaches a masonry reinforcement system. The patent teaches a reinforcement system that includes a number of tensioning rods extending from the top to the bottom of a masonry wall structure in spaced columns. In each column, several rod segments are interconnected at each floor diaphragm using a double conical connector assembly. Each type of connector assembly is embedded in a pocket formed in the masonry wall structure using a hardenable grout.

U.S. Pat. No. 6,098,357 issued to Franklin, et al., teaches a modular precast construction block system with a wall subsystem and a foundation subsystem. The wall subsystem has a number of wall units having cavities and pre-stressed tension cables. The wall units are aligned to form walls with vertically aligned cavities. Threaded wall bars and extension bars are threaded through the cavities. The foundation subsystem includes a variety of precast foundation members.

U.S. Pat. No. 8,225,578 issued to Ronagh, et al., teaches a method for construction of a wall using flexible interlocking mortarless wall units. Briefly, the patent teaches a wall foundation, with foundation tendon rods, that is first constructed with a set of mechanical fastenings attached to the foundation tendon rods. A wall structure is created by vertically stacking a plurality of wall units onto the threaded tendon rods and affixing the wall units using the mechanical fastening. A plurality of roof connecters and rods are attached to horizontally form a network of roof rods, which interconnect the walls for building a roof.

U.S. Pat. No. 5,899,040 issued to Cerrato, et al., teaches a masonry wall system made of masonry blocks each consisting of interlocking dovetails combined with vertical and horizontal mating surfaces. The main block has two stabilizing holes through the center, and steel reinforcement rods are inserted into these stabilizing holes. The masonry components and loosely placed rods have predetermined tolerances, which permit the wall to have a fluid property. When all of the masonry components reach the peak of their tolerance, the wall locks up as a solid interconnected mass, and the force is then passed on to the stabilizing rods.

SUMMARY OF THE INVENTION

In one embodiment, the present invention is a unit for a wall comprising: a single face shell having an interior surface and an exterior surface, a top surface and a bottom surface, and a first end and a second end, wherein the interior surface has a transverse axis running from the top surface to the bottom surface of the face shell, and one or more webs having a front end and a rear end, wherein the rear end of each web is integral with or attached to the interior surface of the face shell along the transverse axis. In one embodiment, the wall unit includes two or more webs that are integral with or attached to the interior surface of the face shell and are each separated with a gap. Other embodiments have webs attached at the front end. Each web further has a fastener-receiving groove located on the front end of the web or a recess in the side of the web to receive a fastening clip. In another aspect, the one or more webs are further defined as having an end opposite the face shell, wherein the end comprises a ledge to support a HAT or furring channel. In another aspect, the one or more webs having a first and a second face, and an opening or opening knock-out that traverses from the first face to the second face of at least one web. In another aspect, the one or more webs further comprise a top and bottom surface and the webs further comprise an opening or opening knock-out that traverses from the first face to the second face of at least one web for, e.g., lifting the unit, as well as another opening that traverses from the first face to the second face but along at least one of the top and bottom surface, or front and rear end for horizontal reinforcements or building services (e.g., electrical, wiring for sound or internet, plumbing, etc.). The face shell and/or web may further comprise one or more ridges or ledges that can be used for lifting the masonry unit, for mechanical strength for the face shell or web, to help provide mechanical restraining or position control for any number of items that are fitted or fixed with the masonry unit, e.g., insulation, plumbing, wiring, etc. The face shell may further comprise one or more face shell lugs in which each face shell lug has portions that form a groove for receiving a fastener. One or more face shells can be fastened together by one or more fasteners that attach to the one or more face shell lugs. The face shell and the one or more webs can be made from at least one of, e.g., cement, concrete, cinder block, aggregate, clay, polymers, copolymers, metals, fiberglass, forming materials, wood, plywood, oriented strand board, particle board, cement board, engineering composite materials, bamboo, hemp, plastic, nylon, polyester, polypropylene, polystyrene.

In another aspect of the unit, the top surface and the bottom surface of the face shell may include one or more horizontal grooves extending from the first end of the face shell to the second end. The horizontal grooves contain one or more horizontal joint reinforcement set into the grooves between the top surface of one unit and the bottom surface of another unit. The one or more horizontal joint reinforcements can be made of, e.g., iron, iron alloys, metal, nickel, steel, steel alloy, stainless steel alloys, aluminum, aluminum alloys, bronze alloys, brass, brass alloys, chromium, copper, copper alloys, polymers, plastic, reinforced polyester epoxy, fiber reinforced plastic, fiberglass, fiber reinforced plastic, fiberglass, engineering plastics, Teflon®, lead, natural or synthetic rubber, or some combination thereof, and can provide mechanical and non-mechanical features to the wall. Alternatively, horizontal joint reinforcement may be installed on the mortar bed joint between units without face shell grooves. Apart from the horizontal grooves and joint reinforcement design, other designs for the top and bottom surface of the face shell include, e.g., a tongue and groove design, dovetail joints, interlocking joints, canal, corrugation, crease, crimp, cut, cutting, depression, ditch, flute, fluting, furrow, gouge, gutter, hollow, incision, notch, pucker, rabbet, rut, scallop, score, scratch, slit, trench, valley, or crenellated joints to provide interlocking capabilities between the surfaces in one or more directions.

Other embodiments of the wall unit exist in terms of the placement of the webs on the interior surface of the face shell. In one aspect, the web closest to the first end of the face shell is integral with or attached to the right of the middle transverse axis of the interior surface of the face shell closer to the second end of the face shell. In another aspect, the web closest to the first end of the face shell is integral with or attached to the left of the middle transverse axis of the interior surface of the face shell closer to the first end of the face shell. In another aspect, the unit may further comprise one or more brick ties embedded in or fastened to the interior or exterior surface of the face shell, or embedded in or fastened to the one or more webs. Another aspect has the one or more webs that are integral with, or attached to, the interior surface of the face shell justified on or radiating out from the middle transverse axis of the interior surface.

The present invention also includes a method for construction of a wall comprising: positioning one or more vertical reinforcement rods or tendons having a first end and a second end, wherein the first end is embedded or mechanically attached to an anchor embedded in a wall-foundation, and laying a first layer of one or more wall units on the wall-foundation with each wall unit comprising: a single face shell having an interior surface and an exterior surface, a top surface and a bottom surface, and a first and a second end, wherein the interior surface has a transverse axis running from the top surface to the bottom surface of the face shell, and one or more webs having a front end and a rear end, wherein the rear end of each web is integral with or attached to the interior surface of the face shell along the transverse axis, and the vertical reinforcement rods or tendons are spaced such that the one or more vertical reinforcement rods or tendons are running through or adjacent to at least one web of the wall unit. Another aspect of this method further comprises laying one or more subsequent additional layers of wall units such that the one or more webs of the subsequent layer is aligned and flush with the one or more webs of the previous layers of wall units, and the one or more vertical reinforcement rods or tendons also run through or are adjacent to the one or more webs of the subsequent additional wall unit layers. Another embodiment of the method for laying wall units includes adding one or more subsequent additional layers that include the first and second ends of the face shells, with the subsequent layers being staggered compared to the first and second ends of the face shells of the previous layers. In one embodiment the vertical rods or tendons are embedded in hardened grout between the unit webs. Another embodiment of the method further comprises the step of creating a downward tension force in each of the vertical reinforcement tendon to provide support to the wall. Different ways of tensioning each of the vertical reinforcement rods or tendons include using a fastener, which further comprises, e.g., a clip, nut, bolt, washer, or screw that secures over a threaded second end of each vertical reinforcement tendon. In another aspect, the masonry units may further comprise one or more brick ties embedded in or fastened to the interior or exterior surface of the face shell, or embedded in or fastened to the one or more webs.

Another aspect of this method includes the wall-foundation being further defined as being capable of withstanding a weight of a wall, and a mechanical force or strain of one or more vertical reinforcement tendons. Embodiments of the wall-foundation further comprise a cast-in-place footing made from, e.g., castable cement, concrete, grout, clay, fiberglass, fiber reinforced polymers, polymers, metals, pressure-wood, compacted aggregate, helical piers, pre-cast concrete or aggregate piers, a pier and beam foundation, or other moldable forming materials.

In another aspect, the method further comprises the step of laying a beam on the top layer of the masonry units, wherein the beam further comprise being made from wood, wood composites, plywood, a reinforced grout bond beam, concrete, cement, iron, iron alloys, metal, nickel, steel, steel alloy, stainless steel alloys, aluminum, aluminum alloys, bronze alloys, brass, brass alloys, chromium, copper, copper alloys, polymers, plastic, reinforced polyester epoxy, fiber reinforced plastic, fiberglass, engineering plastics, Teflon®, lead, natural or synthetic rubber, steel reinforced concrete, or any combination thereof. Additionally, the beam further comprises one or more opening for each vertical reinforcement tendon to go through to further provide stabilizing and support for the tendons. In yet another aspect, the method further comprises positioning a cap on top of the beam or the top layer of wall units wherein the cap has one or more holes for each vertical reinforcement tendon to go through to stabilize and support the vertical reinforcement tendons. The cap further comprises being a single elongated piece with one or more holes, or separate pieces each with holes.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
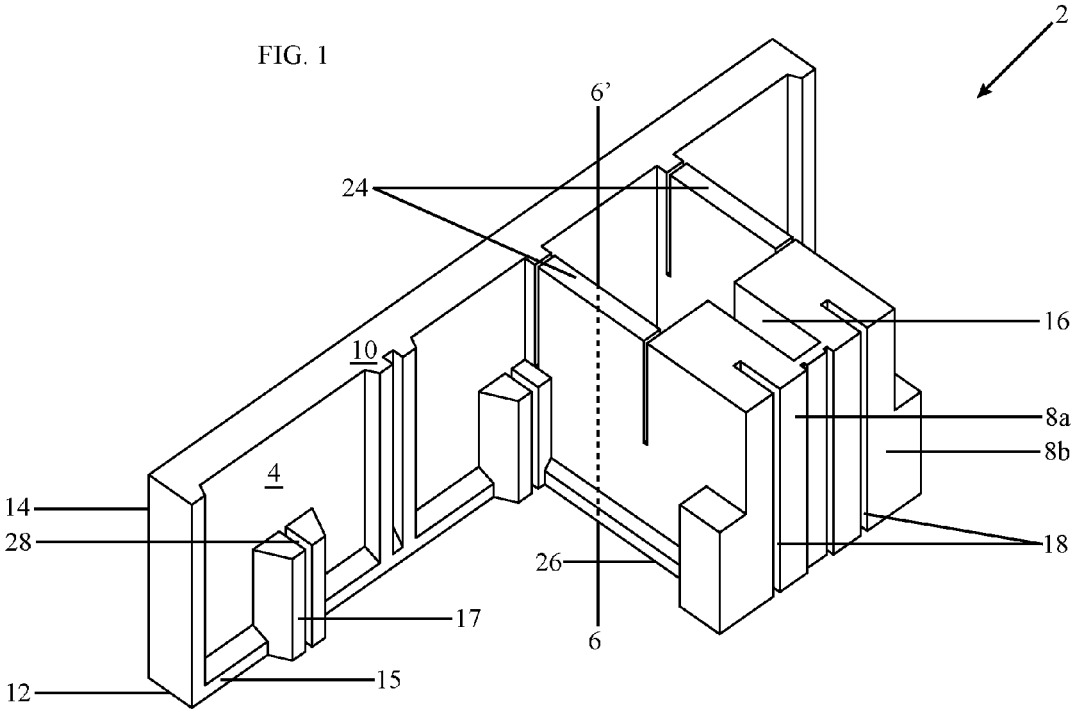
FIG. 1 is a perspective view of the wall unit incorporating the teachings of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The present invention includes a wall unit for assembly into a masonry wall. The wall unit includes a single face shell with one or more webs attached or integral therewith. A face shell is the outer (or inner) sidewall of a concrete masonry unit, in other words, the face shell can be either on the outside or the inside of the structure. In the examples shown herewith the face shell is an exterior version of the wall unit. A web is a portion of the wall unit that extends from the face shell.

The face shell and web can be made from the same material (or different materials), including but not limited to, castable cement, concrete, cinder block, clay, polymers, copolymers metals, forming materials, wood, aggregate, clay, plywood, oriented strand board, particle board, cement board, engineering composite materials, bamboo, hemp, plastic, nylon, polyester, polypropylene, polystyrene, metal, and combinations thereof. The portions of the wall unit that contact the foundation (or a wall unit above an existing wall unit) will often include a transition that provides mechanical attachment and/or insulation, e.g., they can include a tongue and groove design, dovetail joints, or crenellated joints to provide interlocking capabilities. Horizontal joint reinforcements (e.g., pencil rods) can be placed in a groove or in a mortar joint between ungrooved units, which is just one example of features or methods used to provide, e.g., mechanical strength, attachment, shear stabilization, and/or insulation between one or more layers of wall units. The horizontal joint reinforcements can be made of iron, iron alloys, metal, nickel, steel, steel alloy, stainless steel alloys, aluminum, aluminum alloys, bronze alloys, brass, brass alloys, chromium, copper, copper alloys, polymers, plastic, reinforced polyester epoxy, fiber reinforced plastic, fiberglass, engineering plastics, coated with Teflon®, lead, natural or synthetic rubber.

Constructing the present invention will generally require a wall-foundation that can support the weight of the wall and/or the strain of one or more vertical reinforcement tendons. The wall-foundation can include, but is not limited to, cast-in-place footing made from castable cement, concrete, grout, clay, fiberglass, fiber reinforced polymers, polymers, metals, pressure-wood, compacted aggregate, helical piers, pre-cast concrete or aggregate piers, a pier and beam foundation, or other moldable forming materials, or it can be a pre-existing surface of, e.g., concrete, ice, rock, dirt, gravel, earth, sand, etc.

The size of each wall unit not limited to a certain width, height, and depth. It is possible that an entire wall is made up of only a single wall unit. The wall units can be of a length along the transverse axis of 4 in, 6 in., 8 in., 12 in., 16 in., 20 in., 22 in., 2 ft., 3 ft., 4 ft., 5 ft., 6 ft., 7 ft., 8 ft., 9 ft., 10 ft., 11 ft., 12 ft., 13 ft., 14 ft., 15 ft., 16 ft., 17 ft., 18 ft., 19 ft., 20 ft., 21 ft., 22 ft., 23 ft., 24 ft., 25 ft., 26 ft., 27 ft., 28 ft., 29 ft., and 30 ft., 40 ft., 50 ft., 60 ft. or more. Likewise with width of the face shell can be 4 in, 6 in., 8 in., 12 in., 16 in., 20 in., 22 in., 2 ft., 3 ft., 4 ft., 5 ft., 6 ft., 7 ft., 8 ft., 9 ft., 10 ft., 11 ft., 12 ft., 13 ft., 14 ft., 15 ft., 16 ft., 17 ft., 18 ft., 19 ft., 20 ft., 21 ft., 22 ft., 23 ft., 24 ft., 25 ft., 26 ft., 27 ft., 28 ft., 29 ft., and 30 ft., 40 ft., 50 ft., 60 ft. or more. The length of the webs can be 4 in., 6 in., 8 in., 10 in., 12 in., 16 in., or more. Generally, the size of the wall unit will confirm with standard building sizes in either metric or imperial units of measure.

In one non-limiting example, a bond beam and/or cap can also placed on top of the wall. The bond beam and/or cap can include but is not limited to reinforced grout bond beam, concrete, cement, iron, iron alloys, metal, nickel, steel, steel alloy, stainless steel alloys, aluminum, aluminum alloys, bronze alloys, brass, brass alloys, chromium, copper, copper alloys, polymers, plastic, reinforced polyester epoxy, fiber reinforced plastic, fiberglass, engineering plastics, metal coated with Teflon®, lead, natural or synthetic rubber, steel reinforced concrete, or any combination thereof.

FIG. 1 depicts an individual wall unit 2, which includes a single face shell 14 with an interior surface 4, and two webs 8*a* and 8*b* integral with or attached to the face shell 14. A transverse axis 6-6' is shown on interior surface 4, and the webs 8*a*, 8*b* are attached to face shell 14 along the transverse axis from the top surface 10 to the bottom surface 12 of face shell 14. The wall unit 2 is not limited to the two webs 8*a*, 8*b*, but can also include e.g., one, two, three, four, five, or more webs. When there are two webs 8*a*, 8*b* or more, they are each separated with a gap 16. Webs 8*a* and 8*b* are also depicted as having fastener-receiving grooves 18 which extend from the top surface 24 of webs 8*a*, 8*b* to the bottom surface 26. Face shell 14 has portions that form a lifting edge 15 along the bottom of face shell 14. The presence of lifting edge 15 provides strength and a gripping feature to face shell 14, especially when face shell 14 is being lifted. Face shell 14 also has portions that form one or more face shell lugs 17 on the interior surface 4 of the face shell 14. Each face shell lug 17 also provides strength to the face shell 15. Each face shell lug 17 may be formed with portions that define a fastener receiving groove 28 for receiving a fastener (not shown in FIG. 1) for fastening the face shell 14 to another wall unit 2 or fastening building services (e.g., electrical, plumbing lines, etc.) to the wall.

Figure 2:
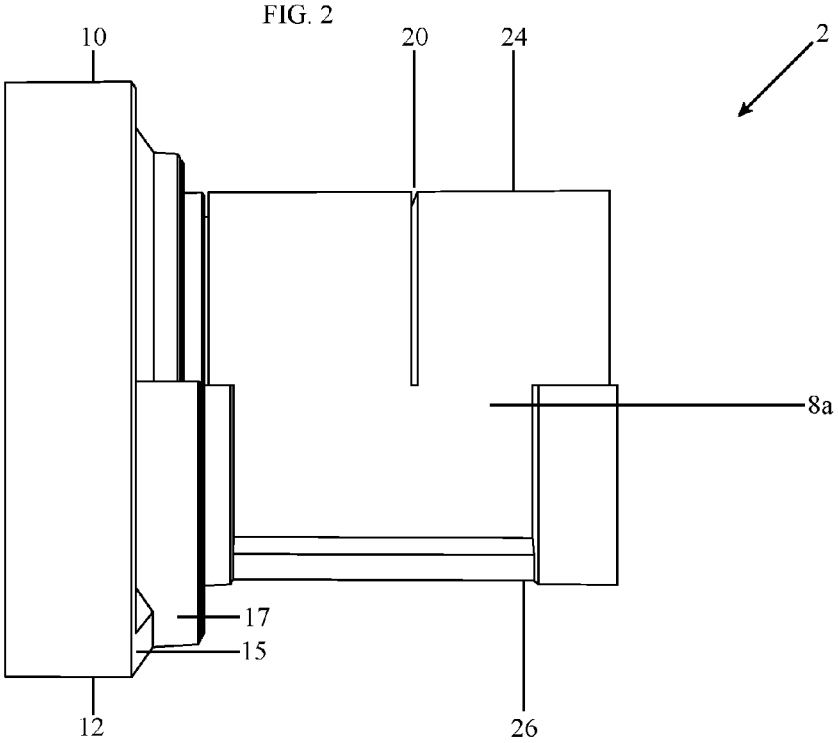
FIG. 2 is a view of the side of the wall unit depicting the first end.

FIG. 2 is a side view of wall unit 2 depicting an opening 20 in web 8*a*, which may be an opening knock-out that may be used e.g., as a lifting pocket for wall unit 2 or for inspection of rods/tendons or to pass building services. Opening 20 can exist in web 8*a*, webs 8*a* and 8*b* (not shown), or all of the webs in a multi-web arrangement, which are integral with or attached to wall unit 2. Opening 20 can function as an opening for e.g., horizontal reinforcements or building services such as e.g., electrical, plumbing, tubing, conduit, vacuum, fiber optic, wiring (communication, telecom, internet, Ethernet, network, IT networks), vacuum, coaxial, conduits, air vents, HVAC, ventilation, refrigeration, gas sources, lighting. Opening 20 is not limited to just being at the top surface 24 of web 8*a*, but can also be positioned along the bottom surface 26 as well, or anywhere throughout web 8*a*. Face shell 14 has portions that form a lifting edge 15 along the bottom 12 surface of face shell 14. Lifting edge 15 provides strength and a gripping feature to face shell 14. Face shell 14 also has portions that form one or more face shell lugs 17 on the interior surface 4 of the face shell 14.

Figure 3:
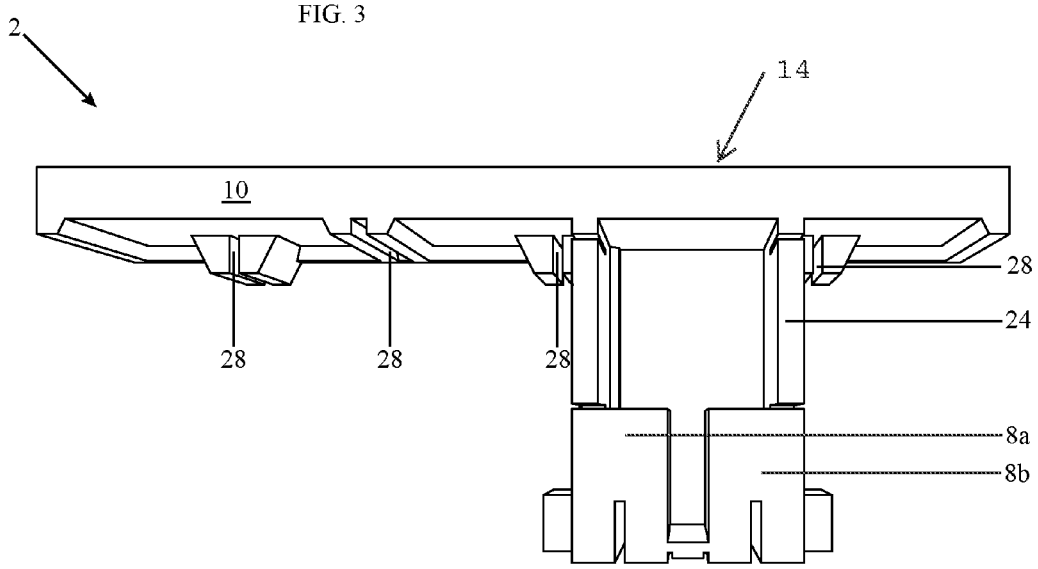
FIG. 3 is a view of the top surface of the wall unit.

FIG. 3 is a top view of wall unit 2 depicting top surface 10 of face shell 14 and top surface 24 of webs 8*a* and 8*b*. Top surface 10 may be formed with portions that define one, two three, four, and five or more receiving fastener grooves 28 shown in relation to the top surface 10.

Figure 4:
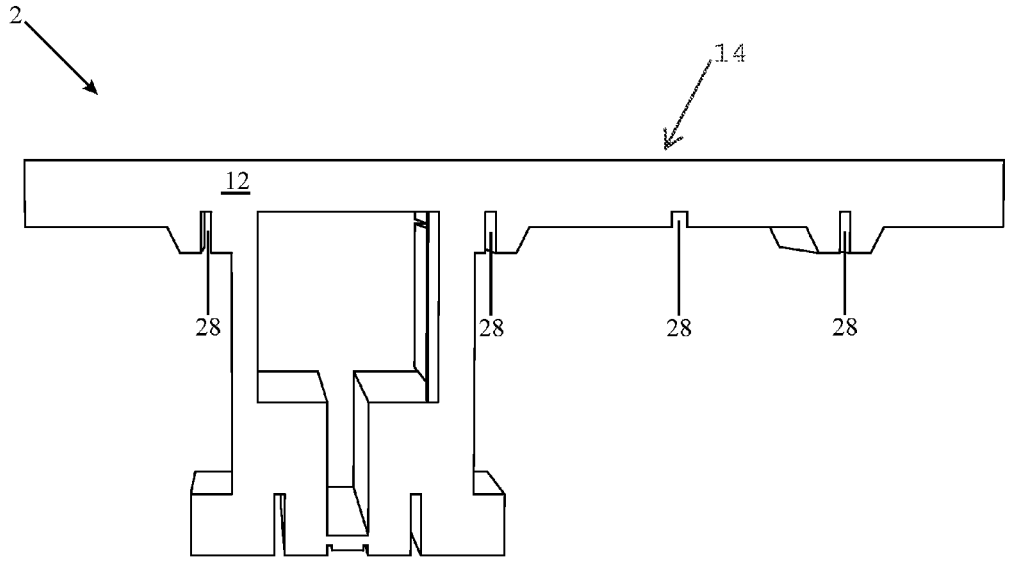
FIG. 4 is a view of the bottom surface of the wall unit.

FIG. 4 depicts the bottom view of wall unit 2 and shows the bottom surface 12 of face shell 14. FIG. 4 also shows the location of the fastener receiving grooves 28 that extend through the bottom surface 12 of face shell 14.

Figure 5:
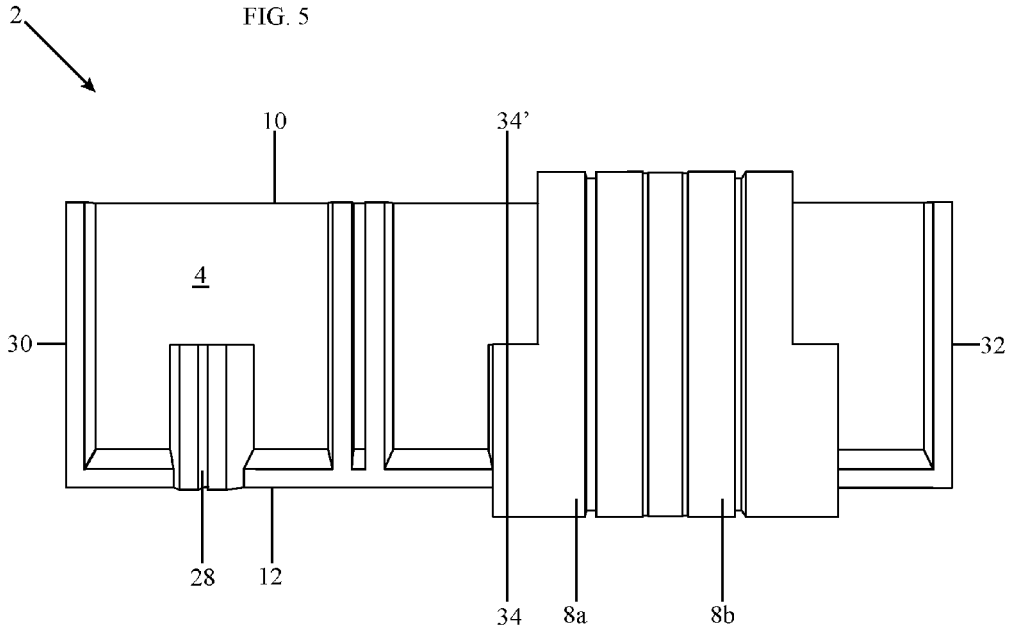
FIG. 5 is a view of the interior surface of the wall unit.

FIG. 5 is a frontal view of wall unit 2 depicting the interior surface 4 of face shell 14. FIG. 5 shows that webs 8*a* and 8*b* are placed closer to the second end 32 of face shell 14 (see FIG. 1) and both are to the right of the middle transverse axis 34-34' of face shell 14. Face shell 14 has portions that form a lifting edge 15 and one or more face shell lugs 17 on the interior surface 4 of the face shell 14. Top surface 10 is shown along with bottom surface 12, fastener receiving grooves 28, shown with line 34-34' to show alignment and side surface 30.

Figure 6:
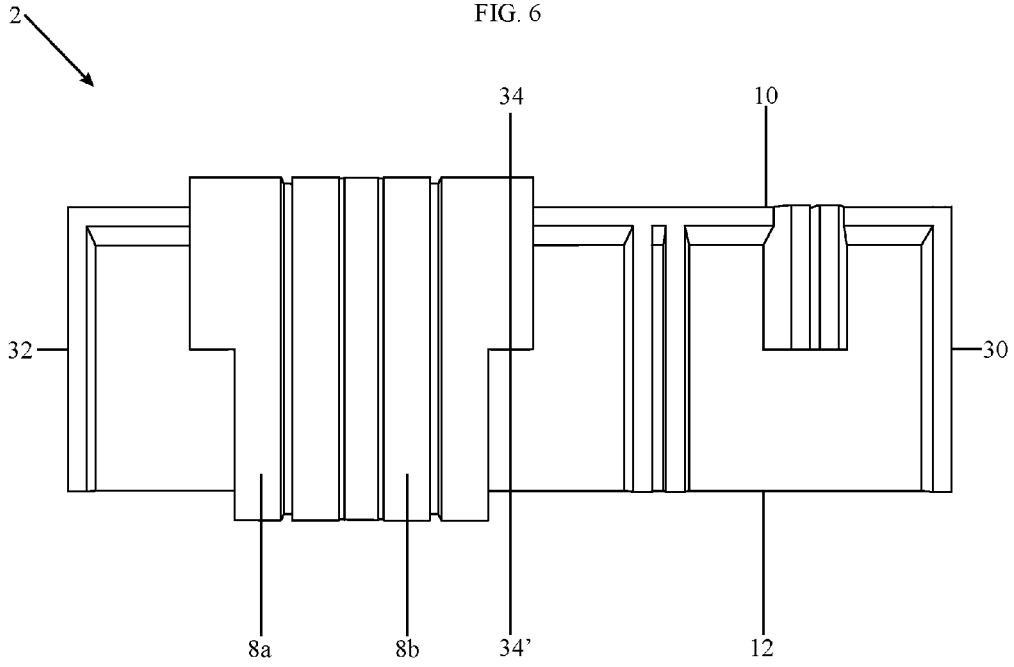
FIG. 6 is an inverted view of the wall unit that is shown in FIG. 5.

FIG. 6 is a frontal view of wall unit 2 showing an inverted view (i.e., rotated 180 degrees) of the wall unit 2 that is shown in FIG. 5. The wall units 2 however are not limited to this type of placements of the one or more webs. Webs 8*a* and 8*b* are placed closer to the second end 32 of face shell 14 (see FIG. 1) and both are to the left of the middle transverse axis 34-34' of face shell 14. Top surface 10 is shown along with bottom surface 12, side surfaces 30 and 32.

Figure 7A:
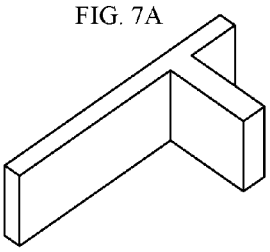
FIGS. 7A to 7O are perspective views of other embodiments of the wall unit incorporating various quantities and configurations of webs.
Figure 7B:
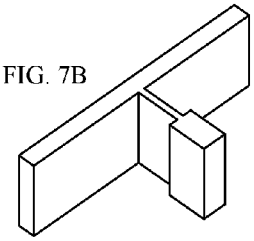
Figure 7C:
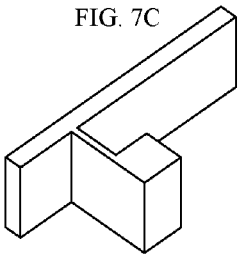
Figure 7D:
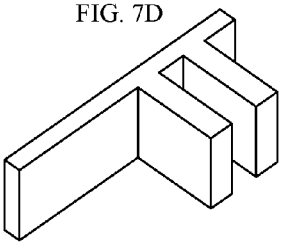
Figure 7E:
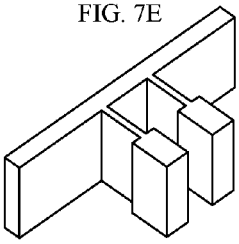
Figure 7F:
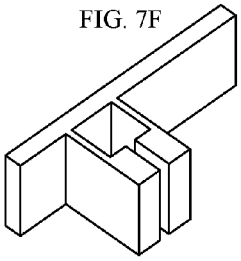
Figure 7G:
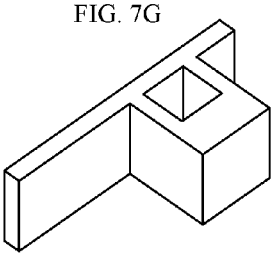
Figure 7H:
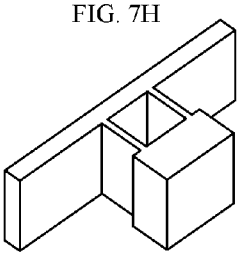
Figure 7I:
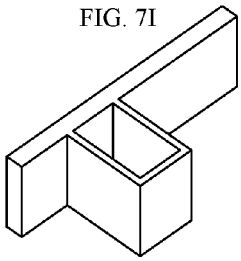
Figure 7J:
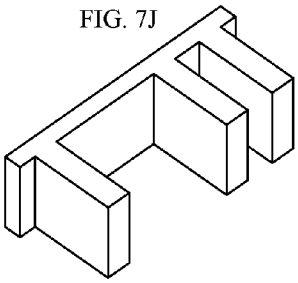
Figure 7K:
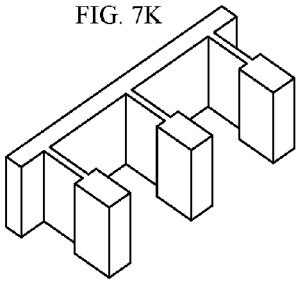
Figure 7L:
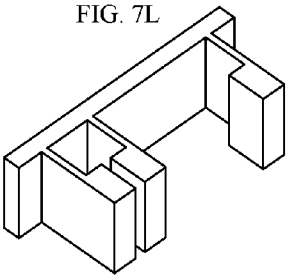
Figure 7M:
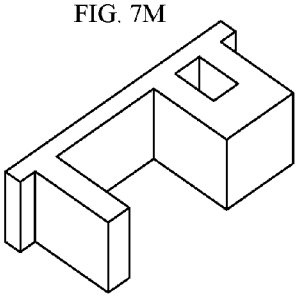
Figure 7N:
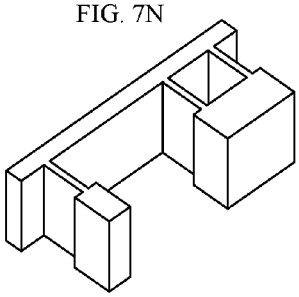
Figure 7O:
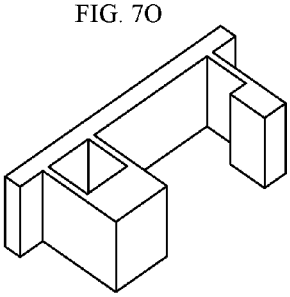

FIGS. 7A to 7O are perspective views of other non-limiting embodiments of the wall unit that incorporate various quantities and configurations of webs and while shown with specific configurations, the skilled artisan will recognized that whether the webs are right-of-center, in the mid-point or left-of-center, these can be configured in the opposite manner and can include any variants of the same. The various figures show the wall unit 2 with: a single web to the right-of-center (7A), a single web in the center with a center-aligned enlarged web (7B), a left-of-center web that is enlarged but not centered (7C), a double web configuration with both webs right-of-center (7D), a double web with each web adjacent the centerline of the wall unit and having an enlarged portion (7E), a double web configuration with both webs left-of-center and having an enlarged portion that extends into the opening between the webs (7F), a double web configuration where the webs are attached to each other and are right-of-center (7G), a centered double web configuration in which the webs are also attached and further comprise additional material outside the opening between the webs (7H), a double web configuration that is left-of-center and is attached without additional material (7I), a triple web configuration with two webs right-of-center and one web left-of-center (7J), a triple web configuration with a web in the center, the right-of- and left-of-center with additional material at the end (7K), a triple web configuration shown with two webs left-of-center and one web right of center with additional material (7L), a triple web configuration with a single web left-of-center and two connected webs right-of-center (7M), a triple web configuration with a single web left-of-center and two connected webs right-of-center both with additional material (7N), and a triple web configuration with a double web left-of-center connected webs and a single right-of-center web (7O). The skilled artisan will recognize that the masonry unit can contain more than three webs, that the exemplary masonry units shown are not limiting but rather show various optional configurations which can be mixed and matched to produce variants on either side, middle, or both.

Figure 8:
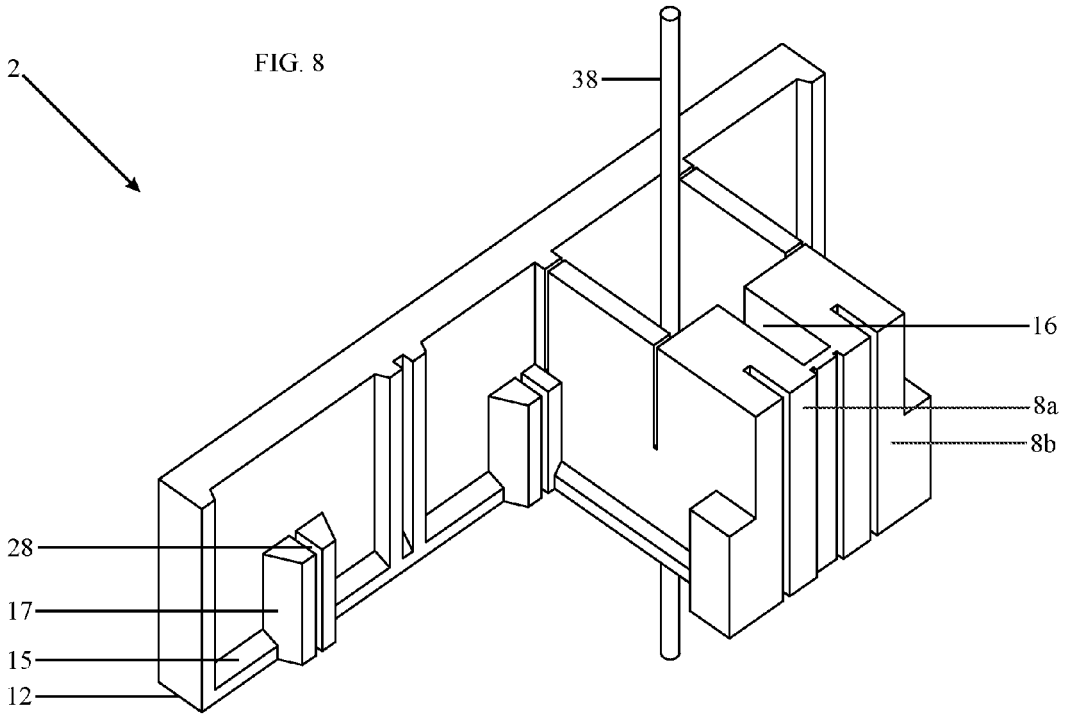
FIG. 8 shows a vertical reinforcement tendon placement adjacent to the webs.

FIG. 8 shows the placement of a vertical reinforcement tendon 38 in gap 16 between webs 8*a* and 8*b* of wall unit 2. Face shell 14 (see FIG. 1) has portions that form a lifting edge 15 along the bottom 12 surface of face shell 14. Lifting edge 15 provides strength and a gripping feature to face shell 14. Face shell 14 also has portions that form one or more face shell lugs 17 on the interior surface 4 of the face shell 14. Also shown are bottom surface 12 and fastener receiving grooves 28.

Figure 9:
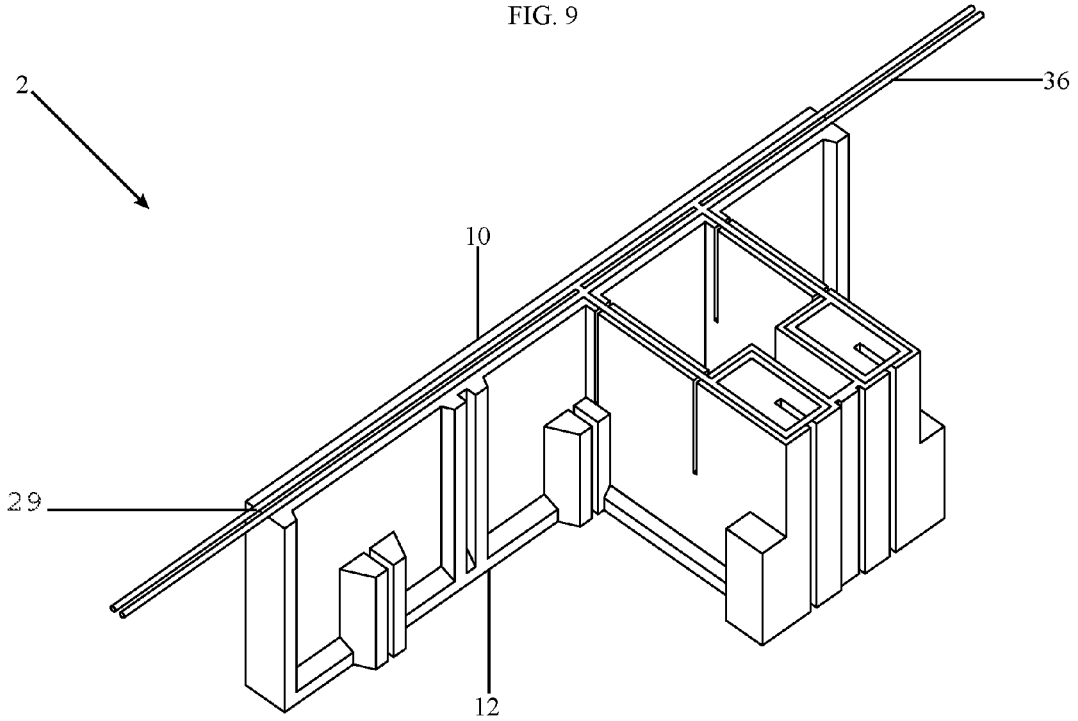
FIG. 9 shows horizontal joint reinforcements placed in a horizontal mortar bed joint between wall units.

FIG. 9 shows the placement of horizontal joint reinforcements 36 on the face shell and webs of wall unit 2. The horizontal joint reinforcements 36 sit between the top surface 10 and bottom surface 12 of different layers of wall units 2, which can be inserted into grooves 29. This is only one example of the construction design between the top surface 10 and bottom surface 12 of different wall units 2. The design serves to provide both mechanical features such as friction and reducing shear movement between the surfaces, and non-mechanical features such as insulation for the wall.

Figure 10:
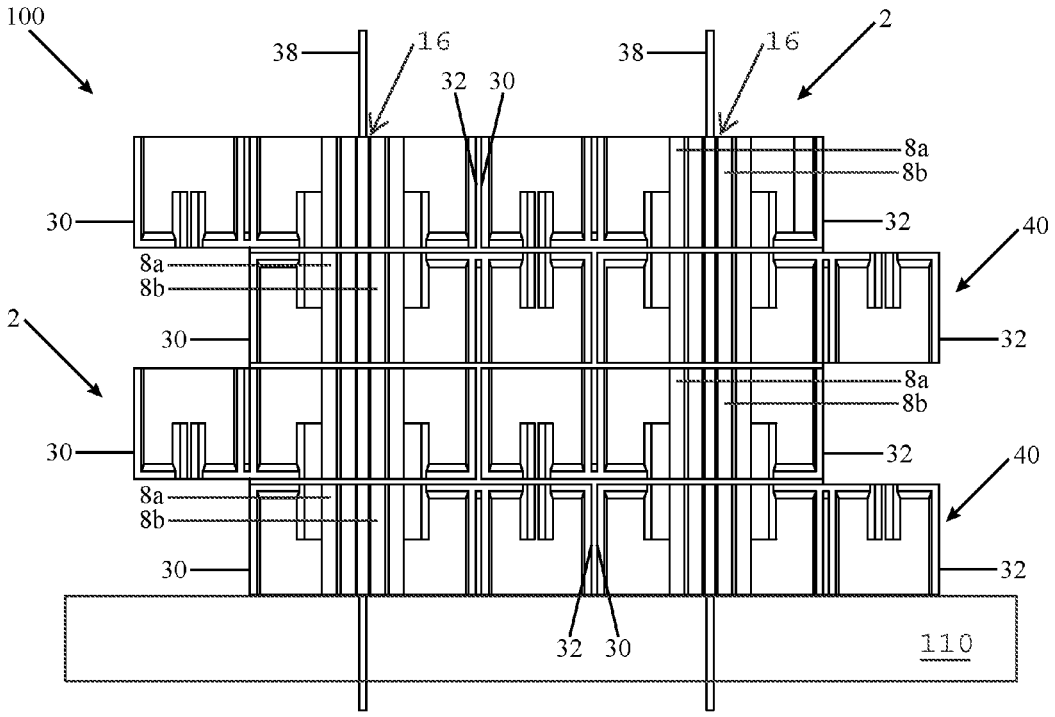
FIGS. 10 to 11 are illustrations of partially completed wall constructed in accordance with the method of the present invention.
Figure 11:
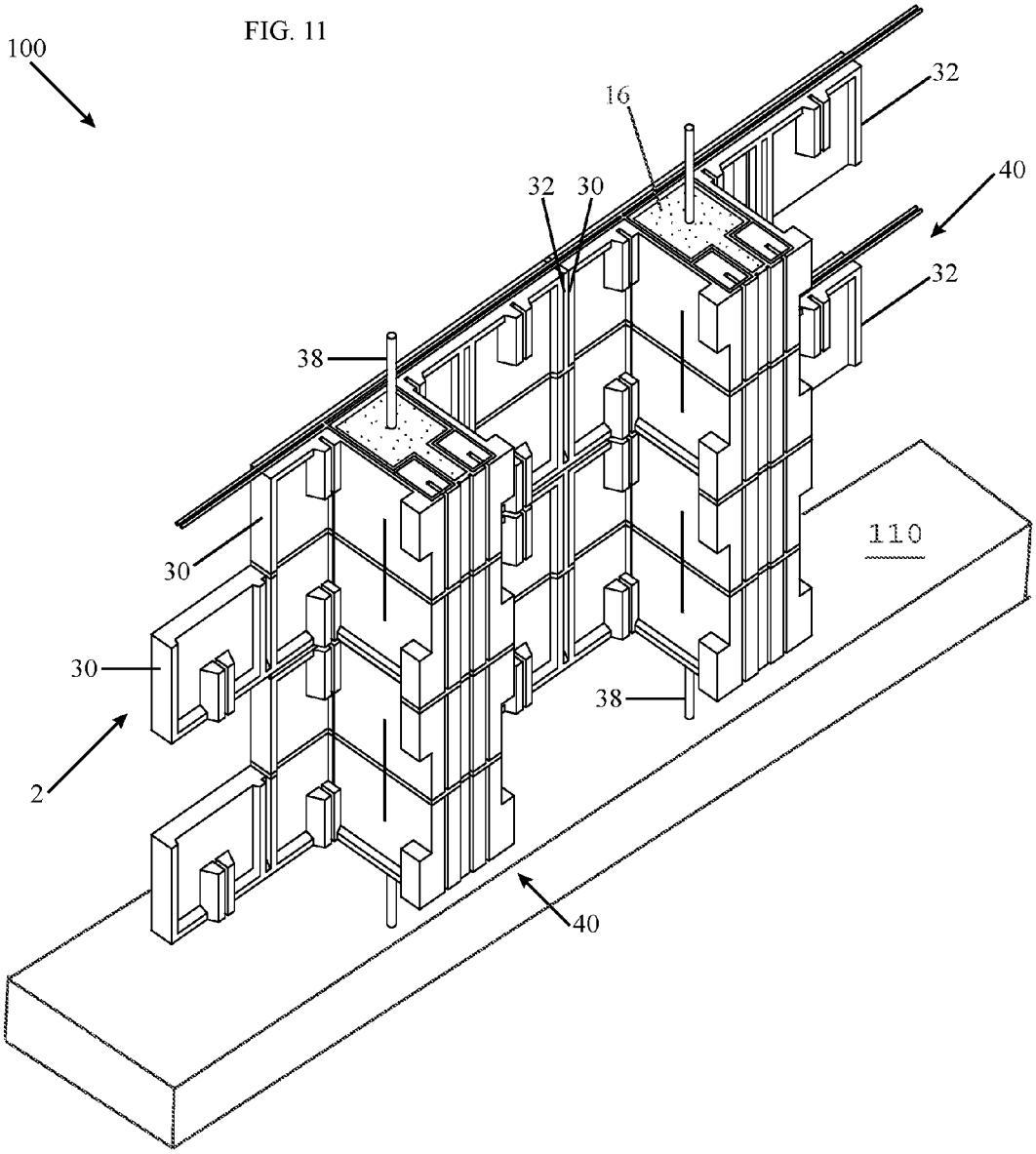

As shown in FIGS. 10 and 11, wall 100 is constructed by first positioning one or more vertical reinforcement rods or tendons 38 in a wall-foundation 110, followed by the laying of a first layer of one or more wall units 2 on the wall-foundation 110 such that the one or more vertical reinforcement rods or tendons 38 are adjacent to webs 8*a* and 8*b* and are in gap 16. The skilled artisan will recognize that the rods or tendons 38 can be a single piece or multiple pieces that are fastened together and tightened and may be pre-inserted into the foundation prior to installation of the masonry units, or may even be added during or even after installation of some of or the entire wall. The wall construction further includes laying one or more subsequent additional layers of wall units 40 such that the webs of the subsequent layer is aligned and flush with the webs 8*a*, 8*b* of the previous layers of wall unit 2. Additionally, the one or more vertical reinforcement rods or tendons 38 also run through or are adjacent to the webs 8*a*, 8*b* of the subsequent layer of wall unit 2. Wall 100 is shown alternating wall unit 2 in an upright and inverted orientation between layers. With the aligning of the webs 8*a*, 8*b*, the different wall units causes the first end 30 and second end 32 of the subsequent layers to be staggered compared to the first end 30 and second end 32 of the previous layers. FIG. 11 is an isometric view of wall 100 showing the alignment of the webs 8*a*, 8*b* that allows the continued placement of the vertical reinforcement rods or tendons 38 to be adjacent to the webs 8*a*, 8*b*, or to potentially go through them and are depicted with a filler, concrete or equivalent in gap 16.

Figure 12:
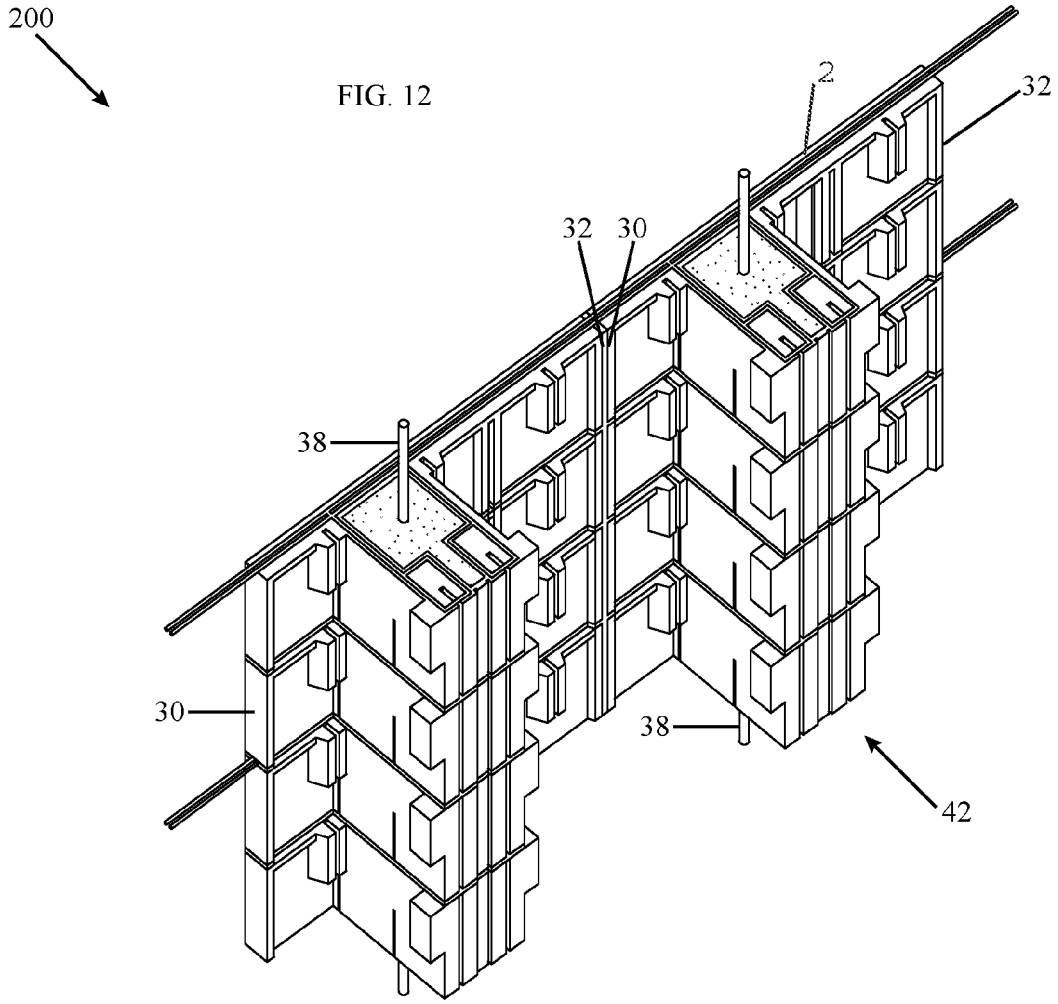
FIG. 12 shows another partially completed wall using a different assembly configuration.

FIG. 12 shows wall 200 constructed with wall unit 2 with all units in an inverted orientation as shown in wall 100 of FIGS. 10 and 11. The first and second ends 30 and 32 in wall 200 are not staggered, but instead are aligned for wall units 42. The webs in wall 200 are also aligned and flush for the proper placement of vertical reinforcement rods or tendons 38. Placement of all units in an upright orientation is another embodiment and will create a similar condition.

After the final layer of the wall unit is laid and the optional bond beam and cap placed, a downward tension is created in the vertical reinforcement tendon to enhance the ability of the wall to receive lateral loading without failing in tension. The creating of the downward tension in the vertical reinforcement tendon can be but is not limited to being accomplished with a fastener such as a clip, nut, bolt, washer, or screw that secures over a threaded second end of each vertical reinforcement tendon. Additional methods include but not limited to physically deforming the vertical reinforcement tendon to also create the downward tension and stabilize the vertical reinforcement tendon.

The single face shell provides access to vertical reinforcement tendon members for inspection, maintenance, and replacement, as well as access to wall interior during or after construction for installation of concealed building services, damp proofing, and insulation. Allowing access to wall interior results in decreases in construction time and increases in construction efficiency.

The masonry unit of the present invention provides several distinct advantages: including but not limited to: singlet sided single face shell: access to interior of wall after erection, which: reduces trade scheduling dependencies; allows installation of: vertical reinforcing/post-tensioning tendon, damp proofing, insulation, building services (elec., plumbing, low-voltage, etc.), and allows inspection of building services (elec., plumbing, low-voltage, etc.) after the wall is erected.

The masonry unit of the present invention also provides an open system, which allows for: modular coursing with standard block; works with installation of conventional non-proprietary (e.g., inexpensive) insulation systems; allows typical or conventional installation for electric, or plumbing), or low-voltage systems; and supports typical interior/exterior finishes other than masonry if desired.

Another advantage of the masonry unit of the present invention is that is uses less material per square foot of wall area (efficient with material and labor) and more wall area per unit (in particular when used as a one-handed unit for installation). Another advantage is that the units can be nested for shipping, pressing and curing, which allows for more efficient manufacturing and palletizing, shipping, and/or staging.

Additional advantages of the masonry unit of the present invention includes that the masonry units are reversible (integral masonry surface (e.g., the face shell) can be inside or out) allowing an earlier building dry-in for accelerated construction schedules. Other advantages include: reinforcing options/flexibility, such as: conventional grouted rebar; and no-grout post-tensioned reinforcing. The masonry units allow for true back dam flashing in single wythe construction, and it also allows industrial buildings to later be upgraded to more finished uses without supplemental framing.

Figure 13A:
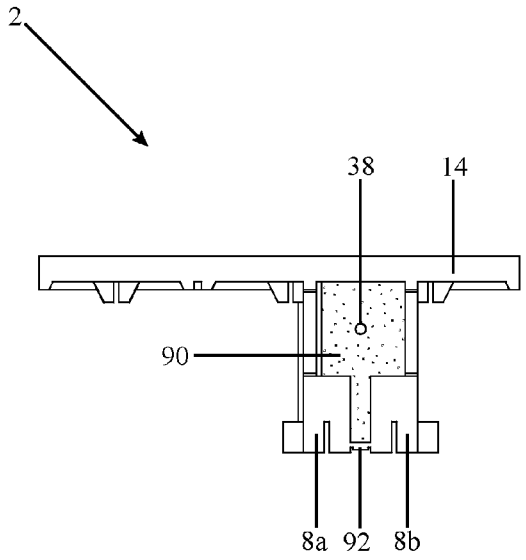
FIGS. 13A and 13B show top views of wall units using the present invention.
Figure 13B:
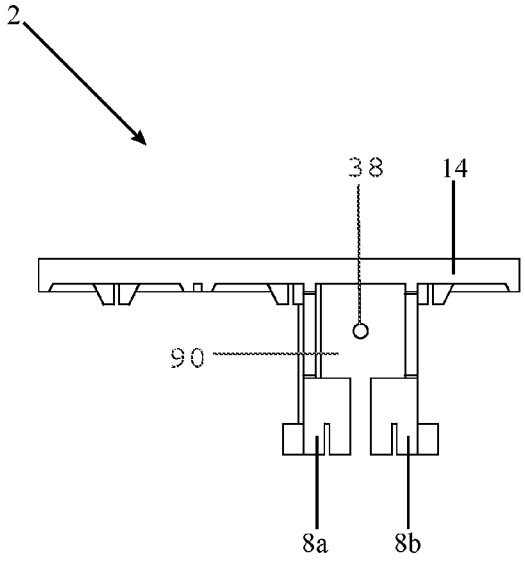

FIGS. 13A and 13B include two top views of masonry unit of the present invention showing two variations for providing mechanical strength to the wall, before, during or after installation. In FIG. 13A, a masonry unit 2, is shown with face shell 14 and webs 8*a* and 8*b*. A vertical reinforcement tendon 38 is shown within a grout 90, which is held in place while hardening using an integral knock-out 92. In FIG. 13B, a masonry unit 2, is shown with face shell 14 and webs 8*a* and 8*b*. A vertical reinforcement tendon 38, but in this version the post-tensioning of the rod provides all the support without the addition of a grout 90 or other packing materials in the space between webs 8*a* and 8*b*.

Figure 14A:
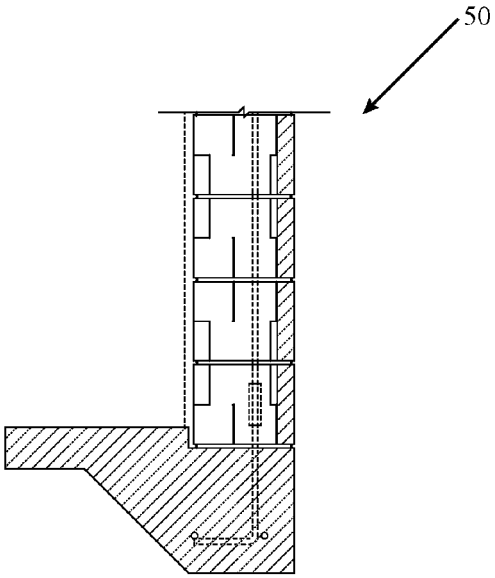
FIGS. 14A to 14D show side views of options for installation of the wall assembly on various types of foundations.
Figure 14B:
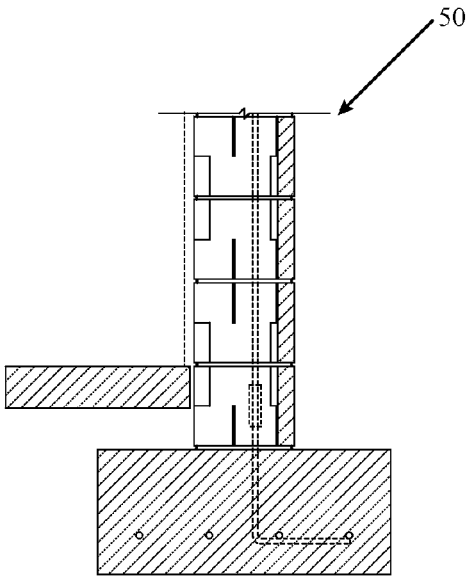
Figure 14C:
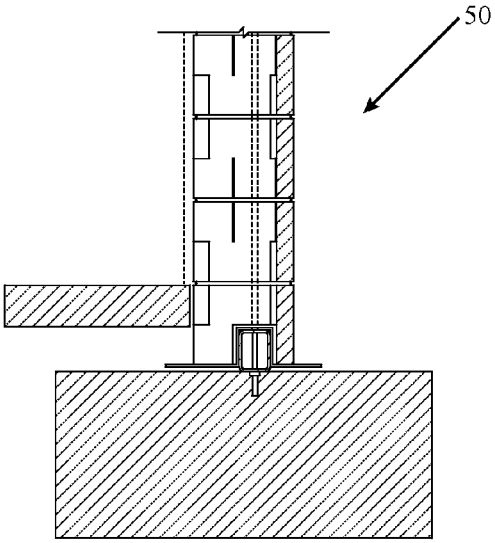
Figure 14D:
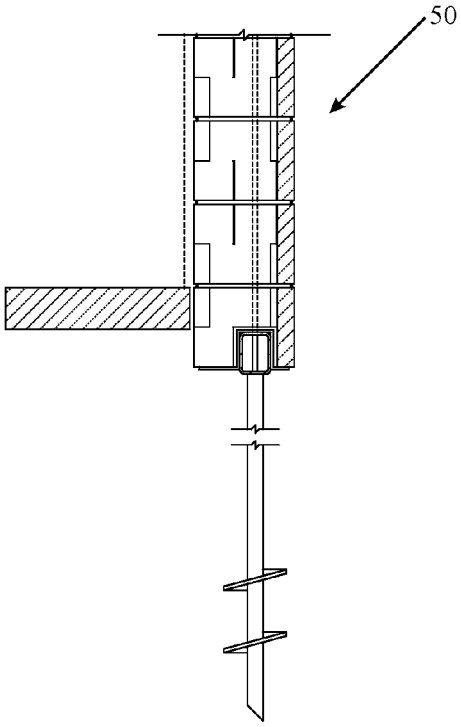

FIGS. 14A, 14B, 14C, and 14D show various side views of wall assemblies positioned on various types of foundations. FIG. 14A shows a vertical reinforcement in which the wall assembly 50 is shown over a footing integrated with a slab on-grade edge. In FIG. 14B, the wall assembly 50 is shown over a continuous linear cast-in-place 'strip' foundation. In FIG. 14C, the wall assembly 50 is shown over a compacted aggregate with steel tube and spreader plates. FIG. 14D shows the wall assembly 50 is shown over helical piers with steel tube and plates.

Figure 15A:
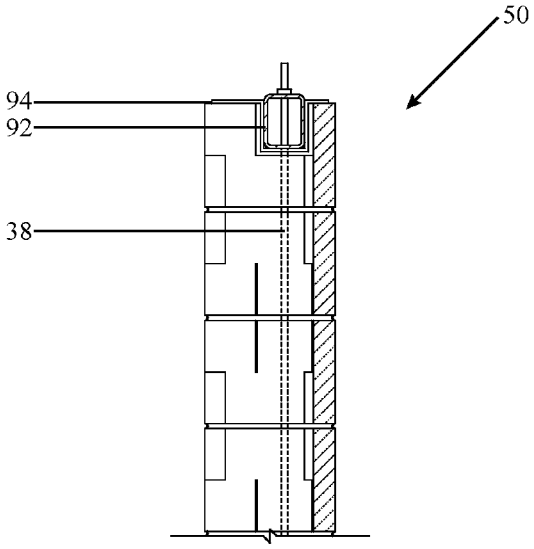
FIGS. 15A to 15C show side views of a wall assembly with three variations for the top of the wall.
Figure 15B:
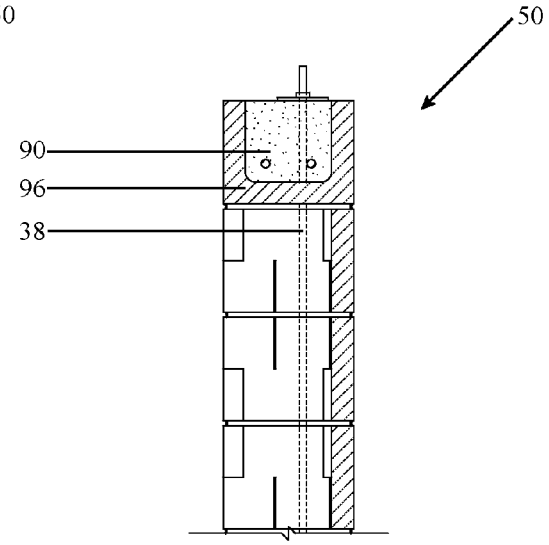
Figure 15C:
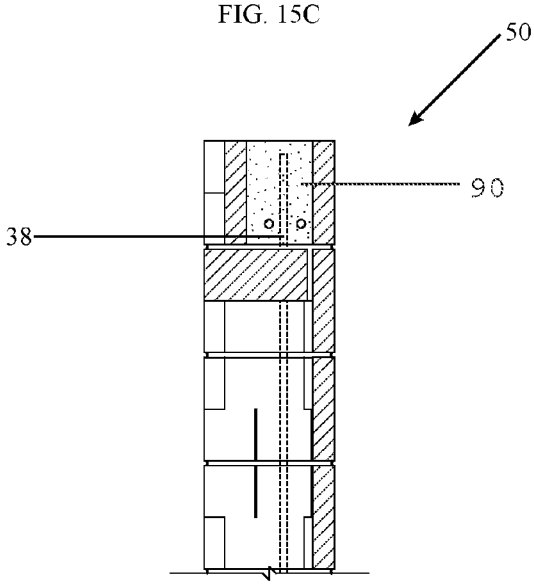

FIGS. 15A, 15B, and 15C show three variants for mechanical support at the top of wall. FIG. 15A shows the use of a tube 92 and spreader plates 94 on wall assembly 50, in relation to the vertical reinforcement tendon 38. In the embodiment shown in FIG. 15B, grout 90 and longitudinal reinforcing is used within a beam 96, shown on wall assembly 50 also, in relation to the vertical reinforcement tendon 38. In FIG. 15C, grout 90 and longitudinal reinforcing is used within a continuous cavity formed by units supported by lugs and ridges of masonry units.

Figure 16A:
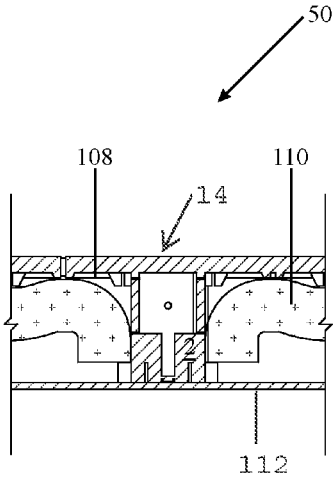
FIGS. 16A, 16B, and 16C show embodiments of wall assemblies in which the face shell serves as the outside wall.
Figure 16B:
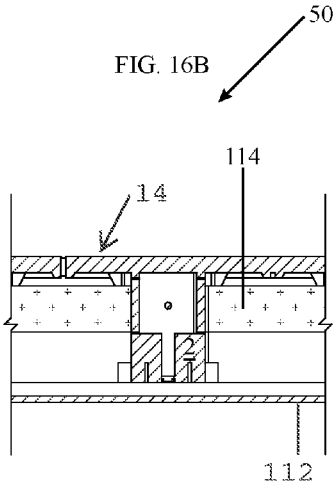
Figure 16C:
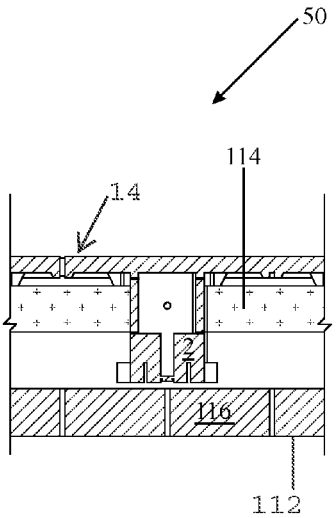

FIGS. 16A, 16B, and 16C show examples of an embodiment of the present invention in which, once the wall has been assembled it can include various finishes using a configuration in which the face shell 14 serves as the exterior wall surface of wall unit 2. The face shell 14 serves as the exterior wall surface, which can be, e.g., sealed, painted directly, and/or can be pre-painted. The wall assembly 50 is shown with an internal damp-proofing 108, batt insulation 110 (also shown for illustration purposes as rigid insulation 114), which can be inserted with friction based on the size of the wall unit and the insulation, or attached with ties, and the interior wall 112. Also for purposes of illustration the interior wall can be a wall-board, e.g., sheetrock, concrete board, fiberglass, or wood (with or without a pre-existing moisture barrier), and/or brick 116.

Figure 16D:
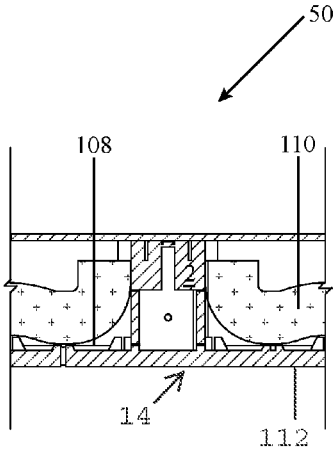
FIGS. 16D, 16E and 16F show embodiments of wall assemblies in which the face shell serves as the inside wall.
Figure 16E:
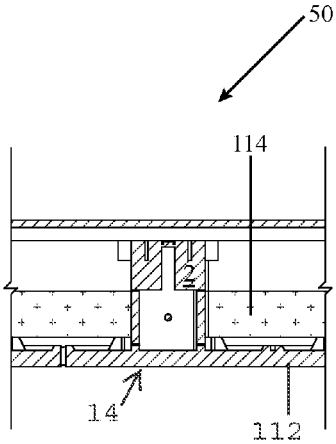
Figure 16F:
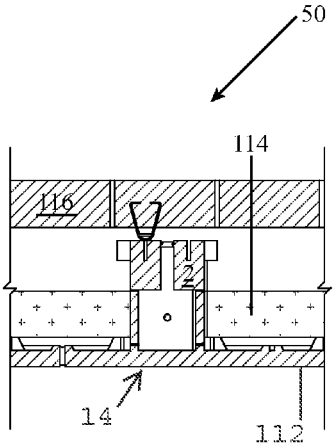

FIGS. 16D, 16E and 16F show examples of an embodiment of the present invention in which the wall, once assembled, has a face shell 14 serves as the interior wall surface. The face shell 14 serves as the interior wall surface, which can be, e.g., sealed, painted directly, and/or can be pre-painted. The wall assembly 50 is shown with an internal damp-proofing 108, batt insulation 110 (also shown for illustration purposes as rigid insulation 114), which can be inserted with friction based on the size of the wall unit and the insulation, or attached with ties, and the interior wall 112. Also for purposes of illustration the exterior wall can be a wall-board, e.g., concrete board, fiberglass, metal, or wood (without or without a pre-existing moisture barrier), and/or brick 116.

Figure 17A:
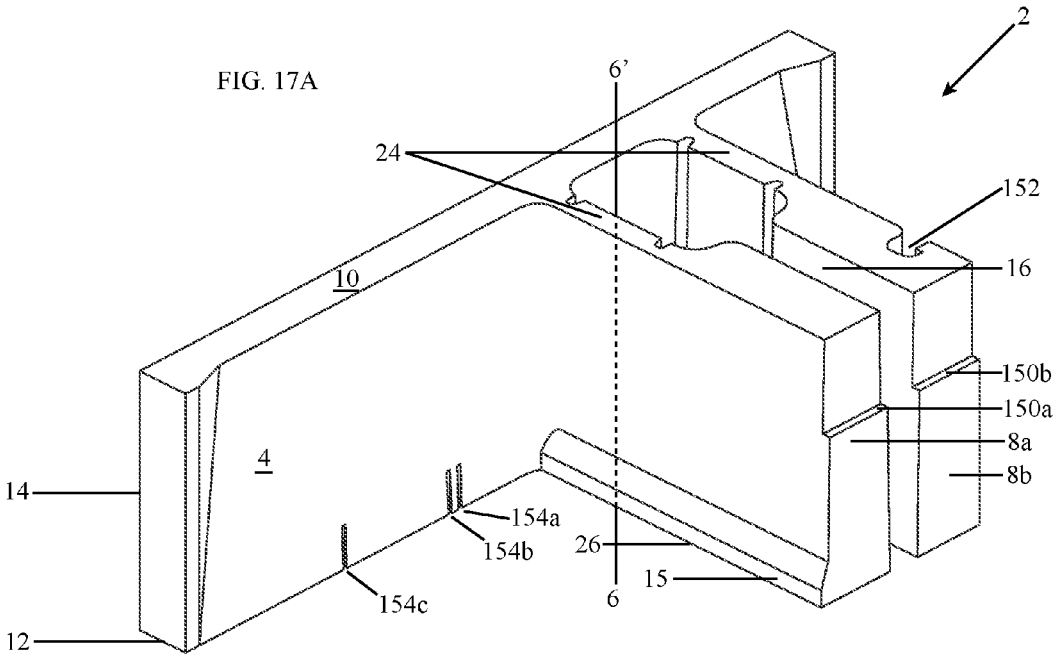
FIGS. 17A to 17D show embodiments of wall assemblies in which a clip pocket and ledge for attachment of interior finish framing is shown, and index marks are included to provide locations for cuts used for blocks in corners and/or window jambs.
Figure 17B:
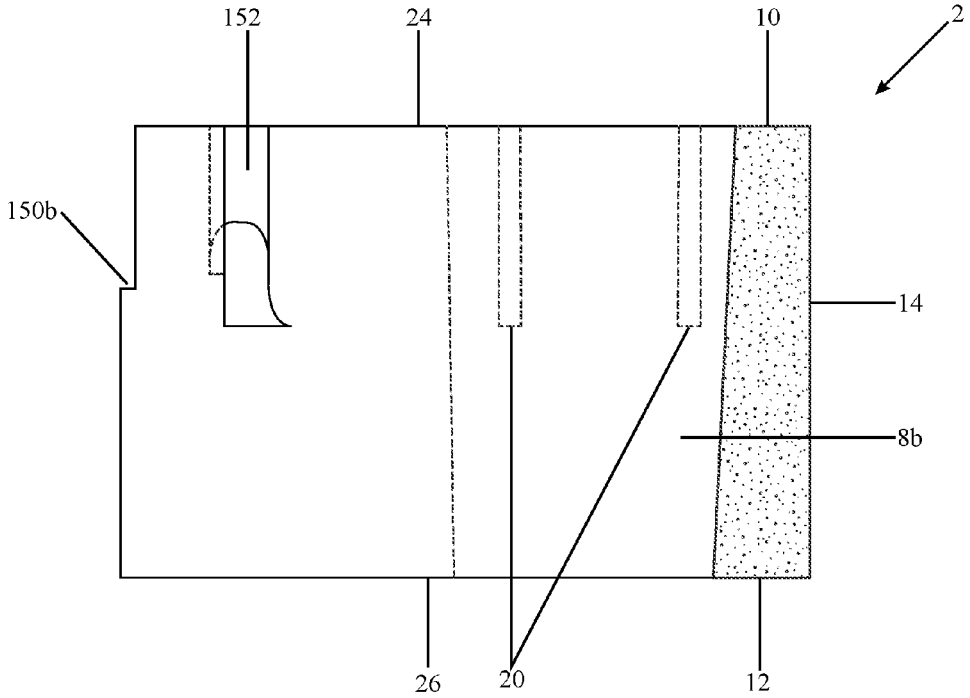
Figure 17C:
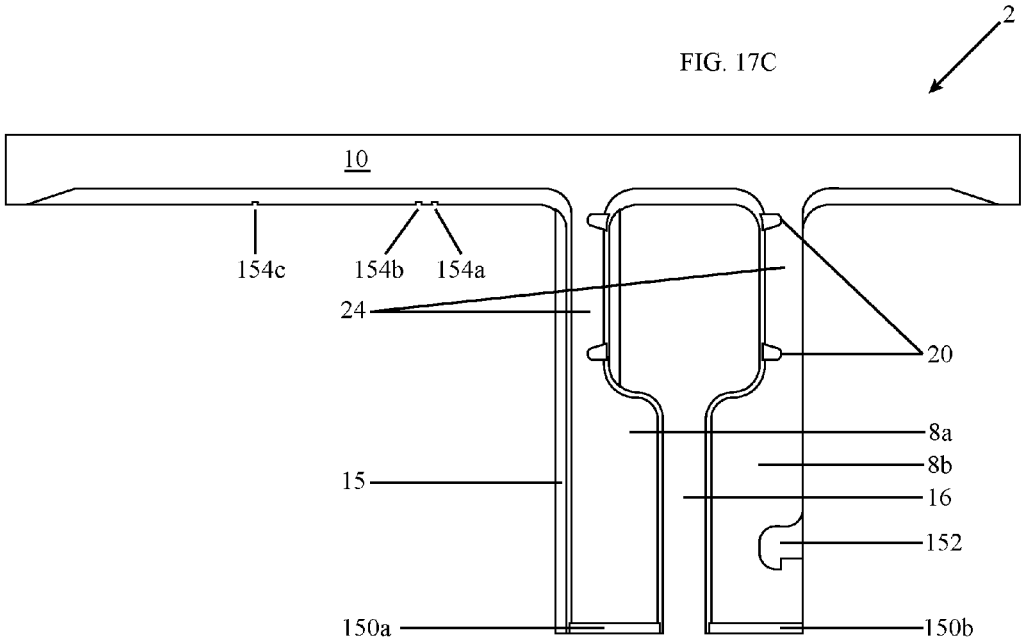
Figure 17D:
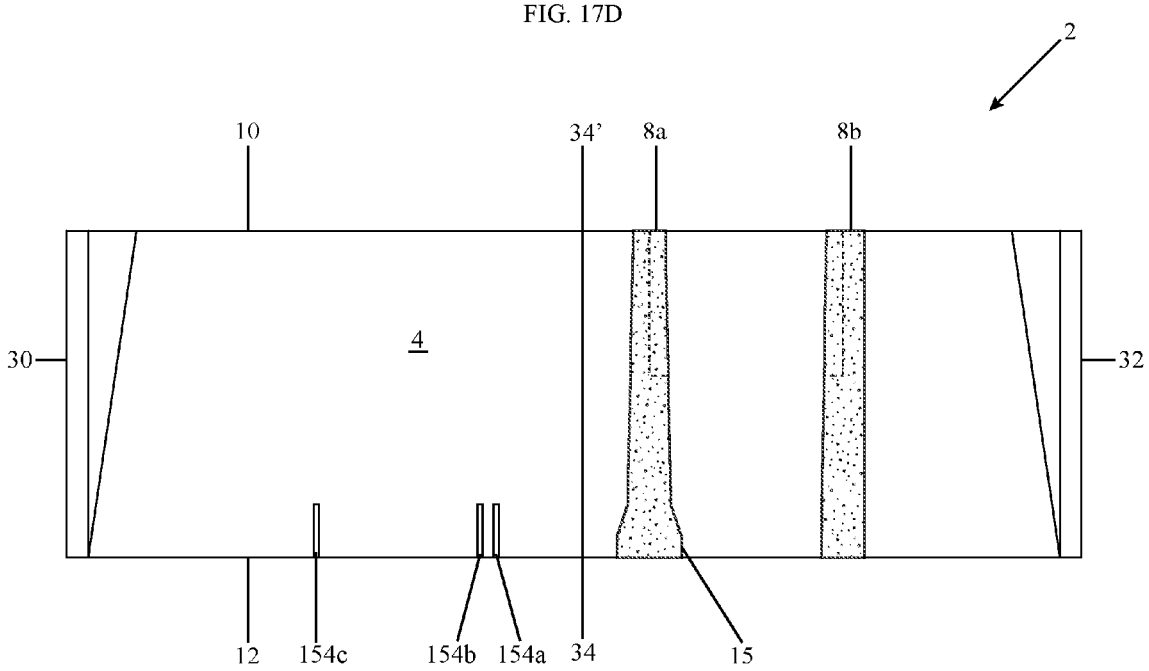

FIG. 17A is an isometric view, FIG. 17B a side view, FIG. 17C is a top-view and FIG. 17D is another side view of an individual wall unit 2, which includes a single face shell 14 with an interior surface 4, and two webs 8*a* and 8*b* integral with or attached to the face shell 14. As depicted in FIG. 17A, this embodiment of the individual wall unit 2 further includes notches 150*a*, 150*b* at the end of the two webs 8*a* and 8*b* opposite the face shell 14 that can be used, e.g., as a ledge for a HAT or furring channel. Also shown in FIG. 17A is a channel 152, designed to receive fasteners, e.g., to receive a tension clip for the attachment of interior finish framing (not shown). In addition, another optional feature shown in this embodiment of the individual wall unit 2 are cut index marks 154*a*, 154*b*, and 154*c*. The cut index marks 154*a*, 154*b*, and 154*c* are spaced to provide convenient marks for cutting the individual wall unit 2 to form corners, door or window jambs. The face shell 14 is depicted in this embodiment having a reduced concrete volume by tapering the interior surface 4 of the face shell 14, until either end of the face shell is reached, wherein the face shell 14 is thickened to a uniform thickness, e.g., 1⅝ inches. The edges of the two webs 8*a* and 8*b* are shown having rounded internal edges to facilitate manufacturing of the units. The two webs 8*a* and 8*b* are shown forming an opening or gap 16 between the webs 8*a* and 8*b*.

Figure 18:
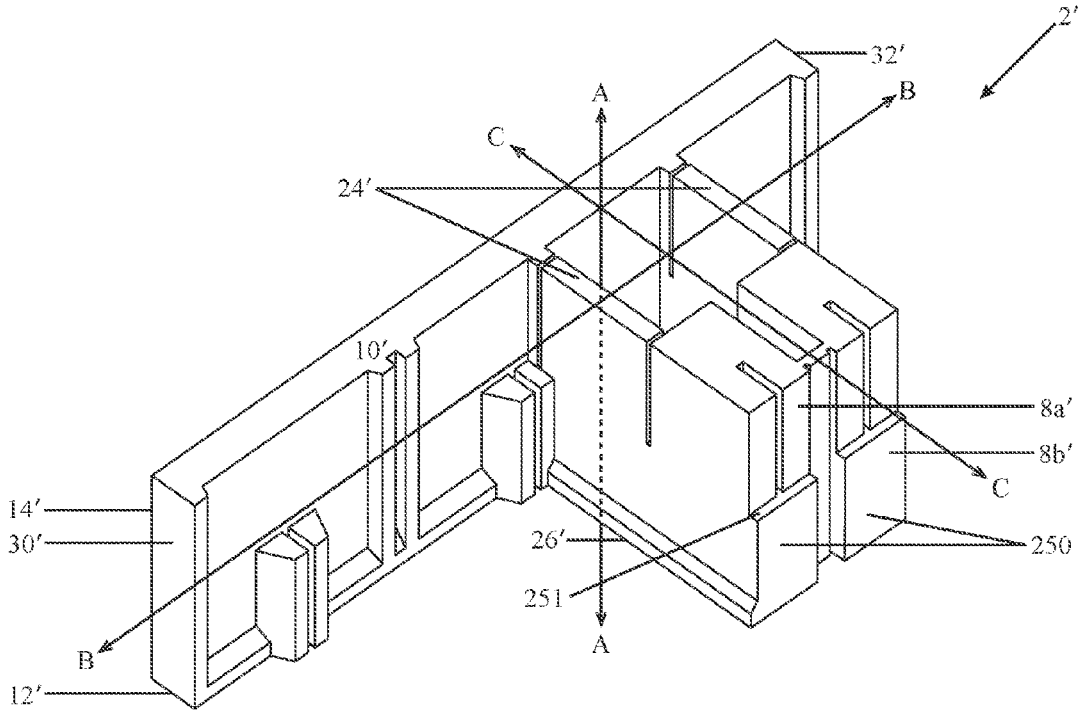
FIG. 18 shows an embodiment in which a ledge extends from distal ends of webs that are coupled together.

FIG. 18 illustrates an embodiment of a unit 2' similar to the embodiment shown in FIG. 1 in that the distal ends of webs 8*a*', 8*b*' are coupled together. However, in this embodiment, a ledge 250 extends from the outer surfaces of the distal ends 8*a*', 8*b*' in the direction of an axis C-C that extends orthogonal to an axis A-A that extends through the top 10' and bottom surfaces 12' of the face shell 14' and an axis B-B that extends through the ends 30', 32' of the face shell 14'. The ledge 250 includes a horizontal surface 251 that is spaced apart from and between the top surface 24 and the bottom surface 26 of the webs 8*a*, 8*b*. The horizontal surface 251 lies within a plane that extends substantially parallel to the axes B-B and C-C.

It is contemplated that any embodiment discussed in this specification can be implemented with respect to any method of construction. It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic (s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

REFERENCES

U.S. Pat. No. 3,222,830
U.S. Pat. No. 3,968,615
U.S. Pat. No. 4,167,840
U.S. Pat. No. 4,986,049
U.S. Pat. No. 5,007,218
U.S. Pat. No. 5,066,440
U.S. Pat. No. 5,138,808
U.S. Pat. No. 5,209,037
U.S. Pat. No. 5,321,926
U.S. Pat. No. 6,513,293
U.S. Pat. No. 7,739,841
U.S. Design Pat. D574,517

What is claimed is:

1. A method for construction of a masonry wall comprising the steps of:

positioning one or more vertical reinforcing rods or tendons having a first end and a second end, wherein the first end is embedded in a wall-foundation; and laying a first course of one or more wall units on the wall-foundation with each wall unit comprising:

a single face shell comprising:

an interior surface;

an exterior surface, the exterior surface being spaced apart from the interior surface;

a top surface;

a bottom surface, the bottom surface being spaced apart from the top surface, wherein each of the top surface and the bottom surface extend between the interior surface and the exterior surface;

a first end surface; and a second end surface, the second end surface being spaced apart from the first end surface, wherein each of the first end surface and the second end surface extend between the interior surface and the exterior surface and between the top surface and the bottom surface, wherein a first axis extends between the top surface and the bottom surface of the face shell along the interior surface, a second axis extends between the first end surface and the second end surface along the interior surface and perpendicular to the first axis, and a third axis extends between the interior surface and the exterior surface and perpendicular to the first and second axes; and a first web and a second web, each of the first web and the second web having a distal end and a proximal end and an inner surface and an outer surface extending between the distal and proximal ends, wherein the proximal end of each web is integrally attached to the interior surface of the face shell, the distal end is spaced apart from the proximal end along a direction of the third axis, at least a portion of the outer surface lies in a plane that intersects the second axis, and the inner surfaces are spaced apart from and face each other, wherein:

the portion of the outer surface of the first web is spaced inwardly of the first end surface or the second end surface, at least a portion of the interior surface of the face shell disposed between the proximal end of the first web and the first or second end surface of the face shell adjacent the outer surface of the first web is visible from the direction of the third axis upon installation of two or more units atop each other, and a ledge extends outwardly from the outer surfaces of the distal ends of the webs in the direction of the third axis, the ledge having a horizontal surface that is spaced apart from and is spaced between upper and lower surfaces of the distal ends of the webs, wherein the horizontal surface lies within a plane that extends substantially parallel to the second and third axes.

2. The method of claim 1, further comprising laying a second course of one or more wall units above the first course such that first or second webs of each of the one or more wall units in the second course are at least one of aligned or flush with the first or second webs of an adjacent wall unit in the first course, and the one or more vertical reinforcing rods or tendons also run through or are adjacent to at least one of the first or second web of the one or more wall units in the second course.

3. The method of claim 1, further comprising laying a second course of one or more wall units above the first course, wherein first and second end surfaces of the face shell of the one or more wall units of the second course are staggered compared to the first and second end surfaces of the face shells of the one or more wall units of the first course, and the one or more vertical reinforcing rods or tendons also run through or are adjacent to at least one of the first or second web of the one or more wall units in the second course-layers.

4. The method of claim 1, further comprising the step of securing a fastener to the second end of the one or more vertical reinforcing tendons, or physically deforming the second end of the one or more vertical reinforcing tendon to post-tension each vertical reinforcing tendon to support the wall.

5. The method of claim 4, wherein the fastener further comprise a clip, nut, bolt, washer, or screw that secures over the second end of each vertical reinforcing rods or tendons which is threaded.

6. The method claim of 1, wherein the wall-foundation comprises a cast-in-place footing made from castable cement, concrete, grout, clay, fiberglass, fiber reinforced polymers, polymers, metals, pressure-wood, compacted aggregate, helical piers, pre-cast concrete or aggregate piers, a pier and beam foundation, or other moldable forming materials.

7. The method of claim 1, further comprising laying a beam on an uppermost course of the wall units.

8. The method of claim 7, wherein the beam comprises wood, wood composites, plywood, reinforced grout bond beam, concrete, cement, iron, iron alloys, metal, nickel, steel, steel alloy, stainless steel alloys, aluminum, aluminum alloys, bronze alloys, brass, brass alloys, chromium, copper, copper alloys, fiberglass, polymers, plastic, reinforced polyester epoxy, fiber reinforced plastic, fiberglass, engineering plastics, PTFE, lead, natural or synthetic rubber, steel reinforced concrete, or some combination thereof.

9. The method of claim 7, wherein the beam further comprises one or more openings for each vertical reinforcing tendon to stabilize and support the vertical reinforcing tendons.

10. The method of claim 7, further comprising positioning a cap on top of the beam.

11. The method of claim 7, further comprising positioning a cap on top of the beam wherein the cap has one or more holes for each vertical reinforcing tendon to stabilize and support the vertical reinforcing tendons.

12. The method of claim 1, further comprising positioning a cap on an uppermost course of one or more wall units.

13. The method of claim 1, further comprising positioning a cap on an uppermost course of one or more wall units, wherein the cap has one or more holes for each vertical reinforcing tendon to stabilize and support the vertical reinforcing tendons.

14. The method of claim 10, wherein the cap further comprises either an elongated single piece with one or more holes for the one or more vertical reinforcing tendons, or two or more separate pieces each with one or more holes for receiving the one or more vertical reinforcing tendons.

15. The method of claim 10, wherein positioning the cap further comprises holding the cap in place with a separate fastener, or screwing the cap onto the second end of the respective vertical reinforcing tendon and post-tensioning the vertical reinforcing tendon.

16. The method of claim 1, wherein the face shell and the first and second webs comprise at least one of cement, concrete, cinder block, aggregate, clay, polymers, copolymers, metals, fiberglass, forming materials, wood, plywood, oriented strand board, particle board, cement board, engineering composite materials, bamboo, hemp, plastic, nylon, polyester, polypropylene, polystyrene, or metal.

17. The method of claim 1, further comprising one or more brick ties embedded in or fastened to the interior or exterior surface of the face shell, or embedded in or fastened to the first or second webs.

18. The method for constructing the masonry wall of claim 1, further comprising:

laying one or more additional courses of one or more wall units above the first layer of one or more wall units wherein the vertical reinforcing rods or tendons are spaced such that each vertical reinforcing rod or tendon is running through or adjacent to at least one of first and second webs of the wall units in the one or more additional courses; and setting at least one of a beam or cap on an uppermost course of one or more wall units wherein the beam or cap each have openings for the vertical reinforcing rods or tendons to stabilize the vertical reinforcing rods or tendons.

19. The method of claim 18 further comprising the step of:

post-tensioning the one or more vertical reinforcing rods or tendons to support the masonry wall.

20. The method of claim 1, wherein the distal ends of the first and second webs are directly coupled together to define a pocket with the inner surfaces of the first and second webs and a portion of the interior surface of the face shell disposed between the inner surfaces of the first and second webs.

21. The method of claim 1, wherein the inner surfaces of the first and second webs face each other and are spaced apart from each other a first distance, the distal ends of the first and second webs are spaced apart a second distance that is less than the first distance, and the distal ends have a thickness as measured in the direction of the second axis that is greater than a thickness of each web adjacent the respective proximal end as measured in the direction of the second axis.

* * * * *